US005720403A

United States Patent [19]

Sawyer

[11] Patent Number: 5,720,403

[45] Date of Patent: Feb. 24, 1998

[54] SHIPPING CRATE

[76] Inventor: Henry W. Sawyer, 5444 Morris St., Philadelphia, Pa. 19144

[21] Appl. No.: 732,126

[22] Filed: Oct. 18, 1996

[51] Int. Cl.[6] ..... B65D 6/14

[52] U.S. Cl. ..... 217/65; 217/13; 220/4.33; 220/4.28; 220/646; 220/692

[58] Field of Search ..... 217/65, 13, 12 R, 217/69; 220/646, 650, 640, 4.28, 4.33, 4.31, 4.32, 692, 730, 675, 669, 670, 672

[56] References Cited

U.S. PATENT DOCUMENTS

| | | | |
|---|---|---|---|
| 1,152,366 | 8/1915 | Backus | 217/65 |
| 1,193,155 | 8/1916 | Klenk | 220/646 |
| 1,658,287 | 2/1928 | Debus | 217/65 |
| 1,943,255 | 1/1934 | Booth | 220/4.28 |
| 2,203,625 | 6/1940 | Friedel | 217/65 |
| 2,876,275 | 3/1959 | Schulz | 217/65 |
| 2,919,826 | 1/1960 | Richter | 220/4.28 |
| 3,259,264 | 7/1966 | Best et al. | 217/65 |
| 3,517,849 | 6/1970 | Presnick | 220/4.28 |
| 5,429,261 | 7/1995 | Machino | 220/4.28 |
| 5,460,292 | 10/1995 | Holman | 220/675 |

FOREIGN PATENT DOCUMENTS

| | | | |
|---|---|---|---|
| 2007719 | 1/1970 | France | 220/4.28 |
| 0302887 | 4/1971 | U.S.S.R. | 220/4.28 |

*Primary Examiner*—Stephen J. Castellano
*Attorney, Agent, or Firm*—Frederick J. Olsson

[57] ABSTRACT

A generally rectangular shaped shipping crate formed from abutting plywood panels and having at each one of the vertices an externally ribbed fitting made from high tensile strength, impact-absorbing plastic fixedly fastened to and securing abutting panels together and having at each joint between abutting panels an elongated, externally ribbed fitting made from high tensile strength, impact-absorbing plastic fixedly fastened to and securing the abutting panels together.

10 Claims, 3 Drawing Sheets

SHIPPING CRATE

This invention relates in general to the materials handling field and in particular relates to the structure of a shipping crate which is especially adapted for use in shipping highly valuable items to insure that the item content is not damaged by the affects of handling usually encountered in shipping and especially not damaged by unusual encounters such as a severe impact due to being dropped.

In one aspect, the invention contemplates a shipping crate comprised of panels add dual function fittings, one function of the fittings being to securely fasten the panels together and the other function of the fitting being able to absorb impacts.

In another aspect, the invention contemplates a generally rectangular shaped shipping crate formed from abutting plywood panels and having at each one of the vertices an externally ribbed fitting made from high tensile strength, impact-absorbing plastic fixedly fastened to and securing abutting panels together and having at each joint between abutting panels an elongated, externally ribbed fitting made from high tensile strength, impact-absorbing plastic fixedly fastened to and securing the abutting panels together.

In a further aspect, the invention contemplates a shipping crate comprised of a removable cover disposed on panels which are integrated with dual function fittings, the latter insuring the structural integrity of the Panels both under normal handling and impact conditions together cover bolts acting as between an annular frame on the top of the cover and an inside flange adjacent the top of the panels and thereby insuring structural integrity of the whole crate.

In a still further aspect the invention contemplate for both side corners and vertices in a panel-type shipping crate olefinic plastic fittings configured for both adhesive and mechanical joining to abutting panels to rigidly secure the panels together and also configured with external ribbing to absorb impact forces.

The various advantages of the invention will be readily apparent to those skilled in the art of fabricating shipping crates from the following description of the invention as illustrated in the drawings wherein.

Figure 1:
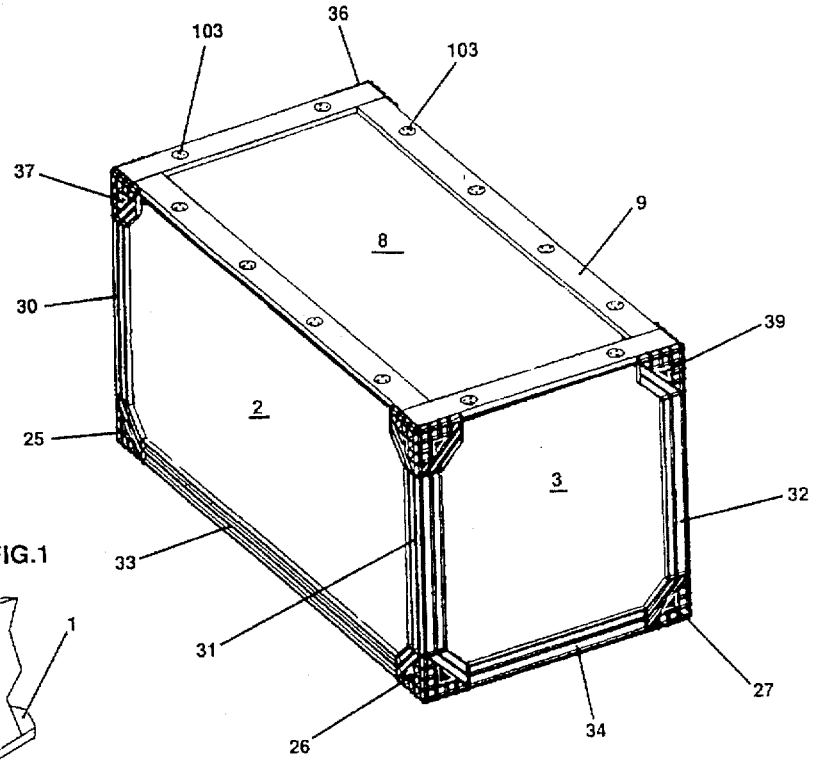
FIG. 1 is a perspective view of a shipping crate constructed in accordance with the invention.
Figure 2:
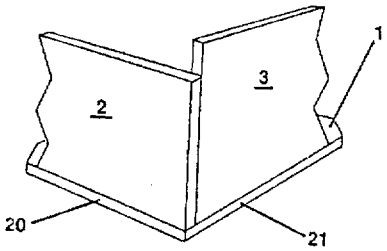
FIG. 2 is a fragmentary perspective view of certain components of the shipping crate of FIG. 1.
Figure 3:
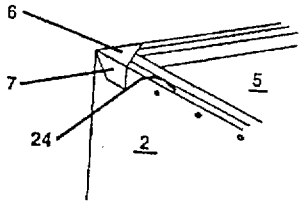
FIG. 3 is a perspective view illustrating a joint retainer.

Referring to FIGS. 1–4, the crate has five rectangular shaped, plywood panels namely, a bottom panel 1 and four side panels 2, 3, 4, and 5. The side panels, 2, 3, and 4 are mounted on the bottom panel and extend normally, upwardly therefrom. The abutting edges/surfaces of the are joined with adhesive and also with nails or staples. Where panels abut at the top, I employ a joint retainer such as retainer 6 shown in FIG. 3 for panels 2 and 5. The retainer overlies the joint and has gripping legs such as leg 7. The retainer is stapled in place.

As will be evident the five panels form a rectangular shaped box. The term rectangular shape naturally includes a cubical shape. I have described the panels as being made of plywood. It will be understood that the term is inclusion of chipboard and particle board, with plywood being the preferred material.

The box is closed off by a cover 8 which is formed from a plywood panel and bas an annular frame 9.

The intersection of the bottom panel with the respective side panels 2, 3, and 4 forms four vertices 10, 12, 12, and 13.

Each two adjacent, abutting side panels form a vertical corner such as the corners 14, 15, 16, and 17. The side panels 2–5 and the bottom panel 1 form four bottom corners 20, 21, 22, and 23.

The bottom panel 1 and side panels 2, 3, 4, and 5 form an interior space and the side panels terminate in a common plane to form an annular common top edge 24.

It is to be noted that the cover 8 is mounted on the top edge 24 as will be commented on later. Also note that the retainer 8 is mounted on the top edge.

The vertices, the bottom corners, and the vertical corners are each covered with a fitting. Each fitting has two important functions one function being to fixedly secure adjacent panels together and the other function being to absorb impact forces. The respective positions of the fittings on the crate will be now be described.

The vertices 10, 11, and 12 are covered with the vertex fittings indicated at 25, 26, and 27. The fitting at vertex 13 is not shown but is identical in construction to the other vertex fittings.

The vertical corners 14–16 are covered with vertical corner fittings 30, 31, and 32. The vertical corner fitting for vertical corner 17 is Dot shown but has the same construction as the other vertical corner fittings.

The bottom corners 20, 21, and 22 are covered with bottom corner fittings 33, 34, and 35. The fitting for bottom corner 23 not being shown but has the same construction as fittings 33, 34, and 35.

The shipping crate also includes top fittings which cover the top portions of the vertical corners 14–17 just above the vertical corner fittings. The top fittings for corners 14–16 are indicated at 37, 38, and 39. The top fitting for corner 17 is not shown but has the same construction as fittings 37–39.

As will be evident, the vertical corner fittings extend between the vertex fittings and the top fittings.

All of the above mentioned fittings have flat interior surfaces to mate with the flat surfaces on the panels. It will be apparent that when corner, top, and vertex fitting are mounted in place, the abutting panels are covered or bridged by a unitary piece. These various fittings are joined to the panels both by conventional construction adhesive applied over the surfaces and by mechanical fasteners. Preferably the fasteners are staples applied by a power operated staple gun. Each staple extends through the fitting into the plywood.

The adhesive is especially desirable because it is applied to cover the joints with the objective of substantially isolating the interior of the crate from the atmosphere.

With the above described bridging arrangement wherein the parts are looked to the panels by adhesive and mechanical fasteners, the panels are effectively immobilzed against relative sliding motion and separating motion.

I will now describe the details of the fittings, starting with the vertex fitting.

Figure 5:
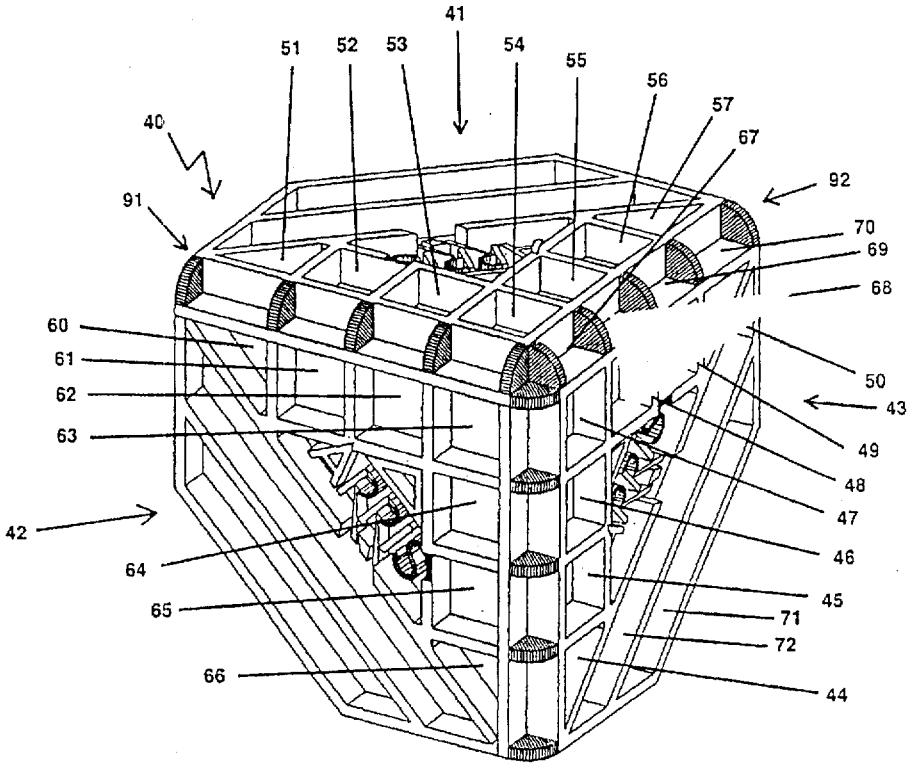
FIG. 5 is a perspective view of a fitting of the invention especially adapted for use at vertices of a shipping crate.
Figure 6:
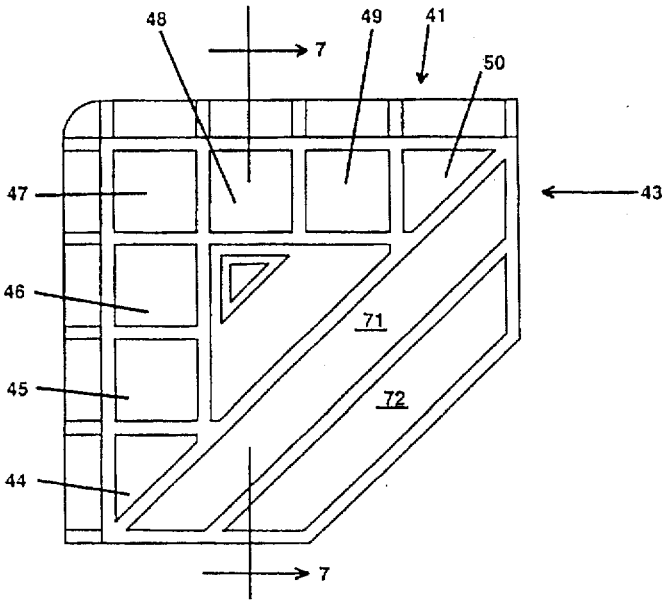
FIG. 6 is a side elevation view looking toward the left in the fitting of FIG. 5 but reduced in size.
Figure 7:
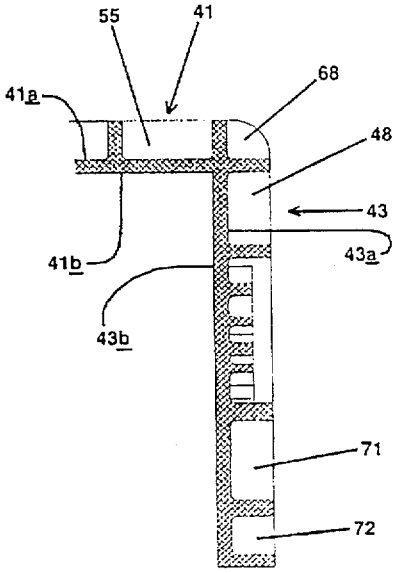
FIG. 7 is a sectional view taken along the lines 7—7 of FIG. 6.

The vertex fittings are identical in construction so the description with respect to the fitting shown in FIGS. 5, 6, and 7 applies to all.

Figure 4:
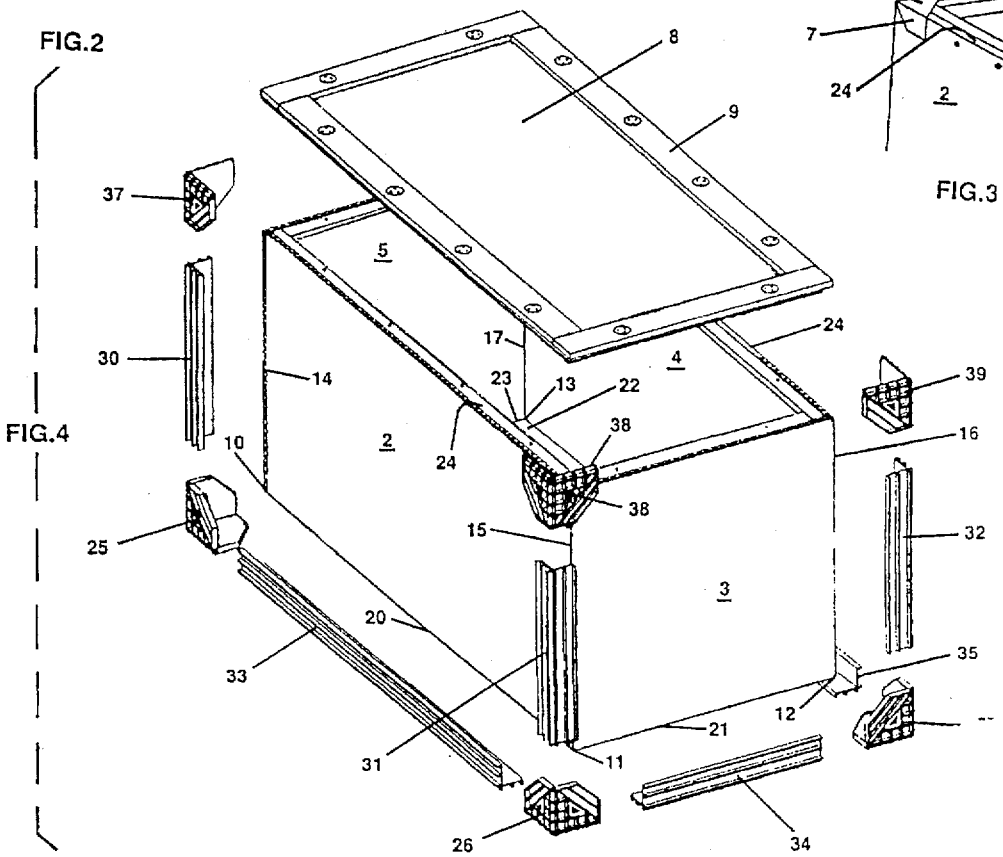
FIG. 4 is an exploded view of the shipping crate of FIG. 1.

With respect to FIG. 5, the fitting 40 is oriented 180 degrees from the corresponding fittings 25, 26, and 27 of FIGS. 1 and 4. This is done for descriptive purposes.

The fitting 40 has three intersecting walls 41, 42, and 43 which are normal to each other.

Each wall has an interior surface and an exterior surface. Thus, referring to FIG. 7, the wall 41 has exterior surface 41*a* and interior surface 41*b* and the wall 43 has exterior surface 43*a* and interior surface 43*b*. The wall 42 has the same interior and exterior surfaces.

Each exterior surface 41*a*, 42*a* and 43*a* has a plurality of outwardly extending ribs arranged in a network.

Referring to wall 43 in FIG. 5, the ribs on the exterior surface 43*a* are those ribs enclosing the spaces designated at 44 through 50.

Referring to wall 41 in FIG. 5, the ribs on the exterior surface 41*a* are those enclosing the spaces 51–57.

Referring to the wall 42 the ribs on the exterior surface 42*a* are those enclosing the spaces 60–65.

At the transition area between adjacent walls there are additional ribs. These are described following.

For the transition area between walls 41 and 43 the ribs in question are those ribs which form the corner spaces 67–70. Note that the exterior ribs forming the spaces 67–70 have curved exteriors.

The transition area between walls 41–42 and the transition area between walls 42 and 43 have identical ribs.

It will be apparent that the ribs forming the various spaces referred to are free-standing in the sence that a rib free to deflect or deform normally from the middle outwardly. The intersecting, interconnecting structure forms a network of ribs.

In addition to the ribs described above, the fitting is provided with elongated ribs which form elongated spaces such as the spaces 71 and 72 for the side 42. These ribs augment the structural integrity of the fitting.

With the above in mind, I will now describe the vertical and bottom corner fittings. These all have the same cross-section and dimensions except for length which is cut to be compatible with the size of the crate.

Figure 8:
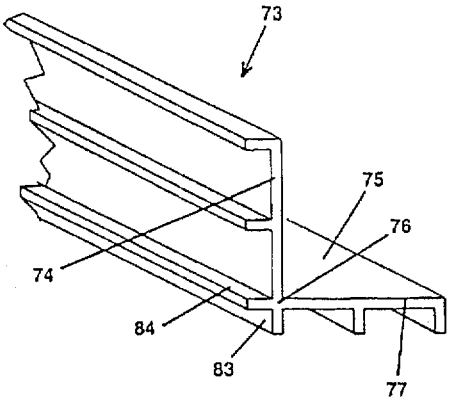
FIG. 8 is a perspective view of the fitting of the invention especially adapted for use at vertical and bottom corners.

Referring to FIG. 8, the fitting 73 is representative of the vertical add corner fitting described in connection with FIGS. 1 and 4.

The fitting includes a pair of walls 74 and 75 which are oriented at right angles to each other and intersect at 76.

The wall 74 has an interior surface 77 and an exterior surface 78. The wall 75 has an interior surface 79 and an exterior surface 80.

The interior surfaces 77 and 79 are flat to mate with the flat panels forming the corners of the crate. The exterior surfaces 78 and 80 are provided plurality of outwardly extending ribs.

The exterior surface 80 has ribs 81, 82, and 83 which are co-extensive with the length of the fitting and are normal to the wall 75 and parallel to each other.

The exterior surface 78 has ribs 84, 85, and 86 which are co-extensive with the length of the fitting and are normal to the wall 74 and parallel to each other.

It will be noted at the intersection 76 of the walls, the adjacent ribs 83 and 84 are oriented at right angles to each other.

The manner of making the top fittings 37, etc. and the manner in which they are applied to the crate will next be described.

Figure 10:
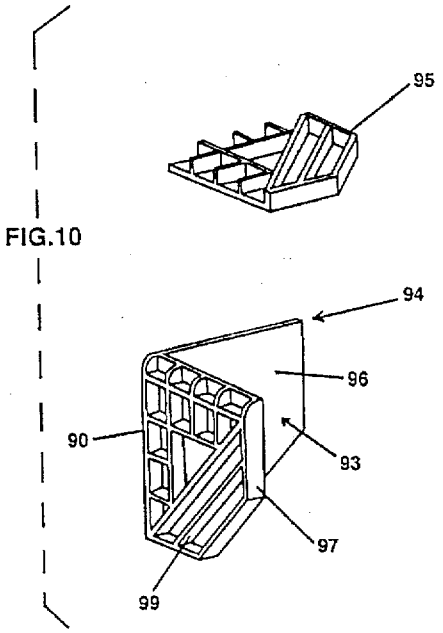
FIG. 10 is an exploded perspective view illustrating a fitting such as the fitting of FIG. 5 severed into two parts.

Referring to FIG. 10, the top fitting 90 has the same structure as the previously described vertex fittings except that one of the side walls has been removed. This is done by sawing through the side wall to be removed.

For example, referring to FIG. 5, say the wall 41 is to be removed, the sawing takes place in a direction indicated by arrows 91 and 92. Referring back to FIG. 10, the arrows 93 and 94 indicate the direction of sawing to remove the wall 95. With removal of side wall 95, the remaining side walls 96 and 97 remain intact.

Figure 11:
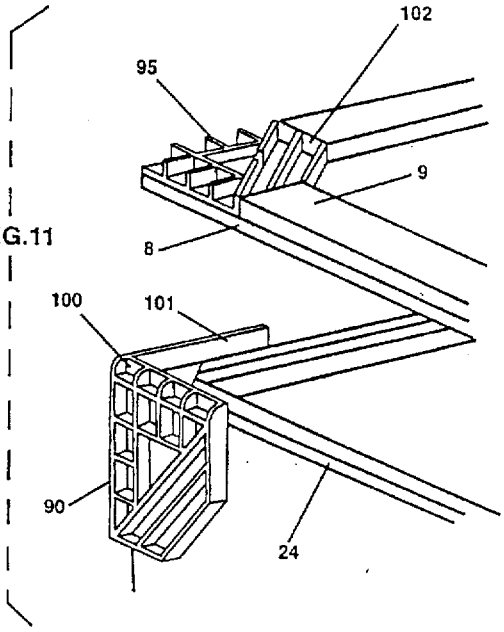
FIG. 11 is an exploded, perspective view illustrating how the parts of FIG. 10 are applied to a shipping crate.

The top fitting 90 is applied to the corner of the crate so that transition section of each wall extends above the top edge 24 as noted in the bottom part of FIG. 11.

In FIG. 11, transition section 100 and 101 cited above edge 24 the same amount as the thickness of the cover B and its frame 9.

Where it is desirable to employ the part 95 in the crate, the frame 9 is made discontinuous adjacent each vertical corner to provide space for the fitting. This is indicated in the top part of FIG. 11 when the fitting 95 is disposed in the corner pocket 102.

While it is not shown in FIGS. 1 and 4, the invention contemplates a single wall fitting at the top of the crate between each adjacent pair of top fittings. The structure for this wall will now be noted.

Figure 9:
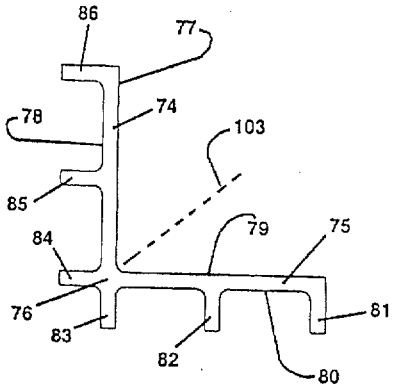
FIG. 9 is an end view of the fitting illustrated in FIG. 8.

Referring to FIG. 9, a length of the fitting is severed, along the dotted line 103 at the intersection 76. The walls 74 and 75 to create two single wall fittings. Each fitting of course has a flat surface to mate with a flat surface on a panel and a plurality of outwardly projecting ribs.

Each single wall fitting is installed between a pair of top fittings with the outer rib (83 or 84) flush with the common top edge 24.

Figure 12:
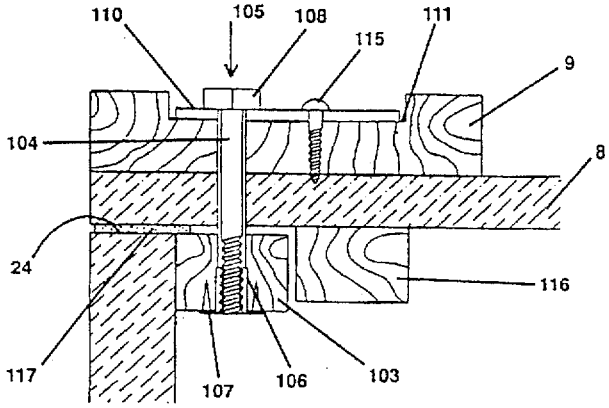
FIG. 12 is a fragmentary view illustrating how the cover is releaseably secured on the crate.
Figure 13:
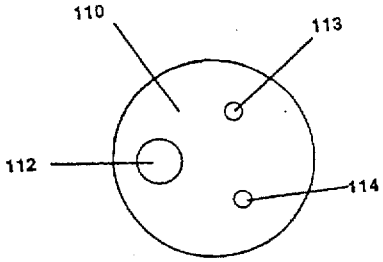
FIG. 13 is a plan view of a disc employed in the construction of FIG. 12.

The cover 8 is releaseably secured to the crate by a fastening arrangement which preserves the structural integrity achieved by the fittings. The arrangement is shown in FIGS. 12 and 13.

Inside of the crate and flush with the top edge 24 is a flange 103. The flange is secured as by construction adhesive and by screws so that effectively the flange is integral with the side panels.

The flange 103, the cover 6, and frame g are provided with coaxial passages which receive the shaft 104 of bolt 105. Within the passage in flange 103 is the post 106 of a T-nut.

The elongated head 107 of the T-nut bears on the bottom of the flange and is held in place by screws not shown. The post 106 in internally threaded and receives the threads of the bolt 105.

The head 108 of the bolt 105 bears on a disc 110 disposed within the recess 111 cut into the flange.

The disc 110 is shown in FIG. 13 and has openings 112, 113, and 114. The opening 112 receives the shaft 104 of the bolt and the openings 112 and 113 each receives a screw for holding the disc in position. One screw as indicated at 115. As will be evident, the underside surface of the head 108 of the bolt 105 bears on the top side surface of the disc 110. The disc bearing surface is much greater than the underside surface of the bolt head. This avoids stress concentration and so is well suited to withstand impact.

Top impacts which tend to distort the rectangular shape of the crate are resisted by the cover 8 and flange, 103. To assist in the foregoing, I have provided a lip 116 coextensive with and closely adjacent to the flange 103. The lip 116 is secured to the cover by screws and adhesive.

It is preferred that a gasket such neoprene gasket 117 be placed on the top edge 24 and engaged by the cover 8. This assists in excluding atmosphere from the crate.

The flange 103, and lip 116 are cut from hardwood and the bolt 105 is made from hardened steel.

Before closing comments with respect to the material and form of the fittings is in order.

The kind of material for the above described fittings is important in order to make the fitting compatible with the fastening/impact absorbing structure.

The invention contemplates an olefinic thermoplastic, the preferred kind being commonly known HDPE or high density polyethylene thermoplastic.

I have found that this plastic has ideal characteristics of tensile strength, shear strength, flexural strength and a of elasticity for use in a crate of the kind described.

The fittings of the invention require both injection molding (vertex fittings) and extrusion (corner fittings) and HDPE is very suitable for both.

In addition, this plastic can be easily penetrated by power driven intrusive fasteners such as staples and nicely compatible with conventional construction adhesive.

The rib structure described heretofore is critical to providing the impact absorbing characteristic. The ribs must be capable of deflecting and/or deforming. HDPE achieves the foregoing with the ribs both in network and parallel form.

It will be understood that in the foregoing I have illustrated and described preferred embodiments of my invention. I do not wish to be limited to the precise details set forth but desire to avail myself of all changes and alterations as may fall with the purview of the claims.

As an example of the above, the crate may be modified using the structural concepts heretofore described to accommodate objects which cannot be safely lifted or set in a box through the top (such as in FIGS. 1 and 4). In such cases, the top and at least one side of the orate is constructed and held in place as previously described.

I claim:

1. For a shipping crate, the subcombination comprising:

five flat, rectangular shaped, plywood panels fixedly joined together to form the crate in a rectangular shape having a bottom panel and four side panels mounted on the bottom panel and extending upwardly therefrom and adjacent panels abutting one another;

the intersection of said bottom panel with the respective adjacent, abutting side panels forming four vertices;

the adjacent, abutting side panels forming four vertical corners and said bottom panel and said abutting side panels forming four bottom corners;

at each of said vertices, a vertex fitting having three intersecting walls, one of which engages the underside of said bottom panel and being fixedly joined thereto and the other two walls respectively engaging abutting side panels and being fixedly joined thereto;

each of said walls having a plurality of outwardly extending ribs arranged in a network;

each said vertex fitting being injection molded from olefinic plastic;

on each said vertical corner and on each said bottom corner, an elongated, two-wall corner fitting, the respective walls of which extend over and engage the abutting panels and being fixedly joined thereto;

the respective walls of each said corner fitting having a plurality of parallel, outwardly extending ribs; and each said corner fitting being extruded from olefinic plastic.

2. A shipping crate comprising;

a flat, rectangular shaped plywood bottom panel;

four flat, rectangular shaped, plywood side panels mounted on said bottom panel and extending upwardly therefrom and adjacent side panels abutting one another and each side panel terminating in a top edge end said bottom and side panels forming interior space;

the intersection of said bottom panel with the respective adjacent, abutting side panels forming four vertices;

said adjacent, abutting side panels forming four vertical corners and said bottom panel and said abutting side panels forming four bottom corners;

said top edges terminating in a common plane to form a common top edge;

a flange connected to said side panels flush with said common top edge and projecting into said interior space;

adjacent the top of each said vertical corner, a top fitting having two intersecting walls, each wall having an interior surface add an exterior surface, the interior surfaces each being flat and respectively engaging the outside surfaces of abutting side panels and fixedly joined thereto and the exterior surface having a plurality of outwardly extending ribs arranged in a network;

said two intersecting walls extending above said common top edge to form a corner pocket therewith;

at each of said vertices, a vertex fitting having three intersecting walls, each wall having an interior surface and an exterior surface, the interior surfaces each being flat and respectively engaging the outside surfaces of abutting side panels and fixedly joined hereto and each exterior surface having a plurality of outwardly extending ribs arranged in a network;

on each said vertical corner, an elongated, two-wall vertical fitting having an interior surface and an exterior surface, the interior surface of each wall being flat and respectively engaging abutting side panels and secured thereto and the exterior surface of each wall having a plurality of outwardly extending ribs parallel to one another;

each said corner fitting extending between a top fitting and a vertex fitting;

a cover comprising a flat rectangular shaped panel disposed on said common top edge and having a frame extending around the periphery with the corners of said cover panel being respectively disposed in said corner pockets; and a plurality of cover hold down fasteners each interconnected between the top of said frame and the bottom of said flange.

3. The shipping crate of claim 2 further including:

at the top of each vertical corner, a joint retainer having three thin, flat sides, one side being disposed on side top common edge and spanning the joint between abutting side panels and the other two sides extending over and engaging the respective outside surfaces of the abutting side panels.

4. The shipping crate of claim 2 further including:

a gasket on side common top surface and engaged by said cover.

5. The shipping crate of claim 2:

further including co-axial passages formed respectively in said frame, said cover, and said flange;

wherein each said hold own fastener comprises;

a disc secured to the topside of said frame and having a plurality of openings one of which is coaxial with said passages in said frame;

screw means extending through at least one of said openings and securing said disc to said frame;

a bolt, the head of which bears on said disc and the shaft of which extends through said one opening in said disc and extends through said co-axial passages;

a t-nut secured to the underside of said flange and receiving the threads of said bolt.

6. The shipping crate of claim 5 further including a plurality of recesses formed in said frame and said discs respectively mounted in said recesses.

7. The shipping crate of claim 2 wherein:

each said top and bottom fitting is a piece formed as by being injection molded from olefinic plastic; and each said vertical fitting is a piece formed as by extruded olefinic plastic.

8. The shipping crate of claim 2 further including:

extending between each adjacent pair of top fittings, a single wall fitting having a flat surface engaging and being fixedly joined to a panel and having a plurality of outwardly projecting ribs extending therealong.

9. The shipping crate of claim 2 wherein:

each said top and bottom fitting and said vertical fitting are joined to the respective panels by adhesive which covers the joint over which the fitting extends.

10. The shipping crate of claim 2 wherein:

said frame is discontinuous adjacent each said vertical corner to provide a fitting space; and in each said fitting space there is disposed a joint retainer engaging said cover, said frame and said top fitting.

* * * * *